United States Patent [19]

Zepell

[11] 4,185,933

[45] Jan. 29, 1980

[54] FLAT, MULTI-ELEMENT WRITING INSTRUMENT

[76] Inventor: Nathan A. Zepell, 1359 Santa Teresita Dr., Santa Barbara, Calif. 93105

[21] Appl. No.: 792,772

[22] Filed: May 2, 1977

[51] Int. Cl.[2] ..... B43K 5/16; B43K 24/04; B43K 27/12

[52] U.S. Cl. ..... 401/104; 401/31; 401/63

[58] Field of Search ..... 401/29, 30, 31, 32, 401/104, 106, 63

[56] References Cited

U.S. PATENT DOCUMENTS

| | | | |
|---|---|---|---|
| 2,108,668 | 2/1938 | Handon | 401/63 |
| 2,767,687 | 10/1956 | Vierling | 401/63 |
| 3,092,080 | 6/1963 | Lovejoy | 401/104 |
| 3,146,758 | 9/1964 | Zepell | 401/104 |
| 3,164,132 | 1/1965 | Ganz | 401/104 |
| 3,170,441 | 2/1965 | Levoin | 401/31 |
| 3,179,086 | 4/1965 | Owadano | 401/104 |
| 3,301,221 | 1/1967 | Von Arx | 401/31 |
| 3,797,945 | 3/1974 | Zepell | 401/104 |
| 3,819,283 | 6/1974 | Pulaski | 401/106 |
| 3,871,775 | 3/1975 | Zepell | 401/31 |
| 3,912,401 | 10/1975 | Zepell | 401/31 |

FOREIGN PATENT DOCUMENTS

| | | | |
|---|---|---|---|
| 1008145 | 5/1957 | Fed. Rep. of Germany | 401/31 |
| 2644958 | 4/1977 | Fed. Rep. of Germany | 401/31 |
| 1022608 | 3/1966 | United Kingdom | 401/31 |

*Primary Examiner*—William Pieprz
*Attorney, Agent, or Firm*—Spensley, Horn & Lubitz

[57] ABSTRACT

A flat, multi-element writing instrument is described in which each writing element is attached to a glide element, a portion of which projects through a longitudinal slot in one face of the instrument's body for manual actuation. The longitudinal slots are located adjacent the side edges of a clip overlying one of the flat faces of the instrument's body. The glide elements include portions which underlie the clip and are received in respective channels formed in the undersurface of the clip, to interlockwith catches formed in these channels and hold their associated writing members in an extended, writing position. A cam within the writing instrument is positioned to have portions in the path of travel of each glide element so that, when one glide element is at least partially moved towards a writing position, the cam automatically pivots to move out of its path of travel and into the path of travel of another glide element to prevent its associated writing element from being extended.

20 Claims, 8 Drawing Figures

FLAT, MULTI-ELEMENT WRITING INSTRUMENT

BACKGROUND OF THE INVENTION

This invention relates to a flat, multi-element writing instrument, particularly one in which the elements are manually actuated by members located on one face of the instrument.

Some writing instruments incorporate multiple writing elements and include mechanisms for selectively actuating these elements to extend them into a writing position. Some instruments also are relatively flat, providing increased comfort to the user among other advantages. Excellent examples of such a writing instrument are presented in U.S. Pat. Nos. 3,871,775 and 3,912,401, granted to the present inventor. As exemplified by the devices described in these patents, flat writing instruments incorporating multiple writing elements provide actuating members on the sides of the pen. When so positioned, these projections can engage the user's hand during use of the instrument, thereby constituting a source of irritation and, occasionally, causing the writing element to be inadvertently released and retracted while still in use. Moreover, such multi-element writing instruments can become jammed when both writing elements are attempted to be extended simultaneously from the instrument. Since such writing instruments are complex to operate, and since few users are disposed to read instructions, jamming presents a significant problem.

An object of the present invention is to provide a flat, multi-element writing instrument in which the writing elements are actuated by projections located on the face of the instrument. Also, another object of the invention is to provide an instrument incorporating means preventing even the partial extension of one writing element while the other writing element is in an extended position, thereby preventing the elements from becoming jammed in the instrument. A further object of the invention is to provide an instrument in which an extended writing element automatically is retracted upon lifting the clip, such as when attaching the instrument to the clothing of the user. Another object is to provide a writing instrument that is simple to operate, one which even an inexperienced user can operate correctly without jamming the mechanism. Still another object is to provide a writing instrument that includes large areas for advertising or designs, areas that are exposed during use and during pocket storage of the instrument.

SUMMARY OF THE INVENTION

A flat multi-element writing instrument is described in which each writing element is attached to a glide element, a portion of which projects through a longitudinal slot in one face of the instrument's body for manual actuation. The longitudinal slots are located adjacent the side edges of a clip overlying one of the flat faces of the instrument's body. The glide elements also include portions which underly the clip and are received in respective channels formed in the undersurface of the clip. These channels include catches that cooperate with the received portions of the glide elements to hold their associated writing members in an extended, writing position. Preferably, the longitudinal slots in the instrument's body are long enough to permit the glide elements to be extended beyond the extended, writing position to cause a sufficient portion of the writing member to be extended from the body of the instrument, permitting it to be grasped, removed and replaced.

A cam, within the writing instrument is positioned to have portions in the path of travel of each glide element so that, when one glide element is at least partially moved towards a writing position, the cam automatically pivots to move out of its path of travel and into the path of travel of another glide element to prevent its associated writing element from being extended. In the preferred form, the clip is pivotally attached to the body of the writing instrument and includes a tip received in an indentation in the body of the instrument to assist the clip in resisting lateral motion. Also, preferably the clip includes an extension that may be manually depressed to lift the clip from the body of the instrument and permit an extended writing element to be retracted by a spring within the writing instrument. In addition, preferably the clip is wide enough to present a substantial surface for advertising or design material, this material naturally being exposed during pocket storage of the instrument.

BRIEF DESCRIPTION OF THE DRAWINGS

The invention will be further described in connection with the accompanying drawings in which.

DETAILED DESCRIPTION OF A PREFERRED EMBODIMENT

While a preferred embodiment of the invention now will be described in detail, it will be apparent to those skilled in this art that this specific, preferred design incorporates various basic features, features which provide significant advantages to the user. Of course, many of these features can be used to advantage in other writing instruments. Also, the structures which provide these features may be modified in various respects while retaining their functions and advantages, as will be apparent to those skilled in this art.

Figure 1:
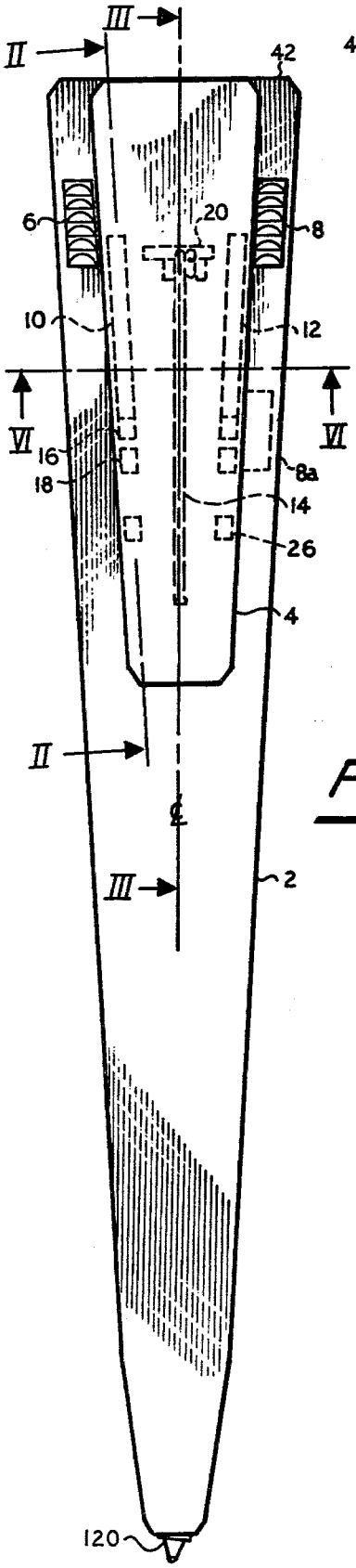
FIG. 1 is a front view of a preferred multi-element writing instrument.
Figure 2:
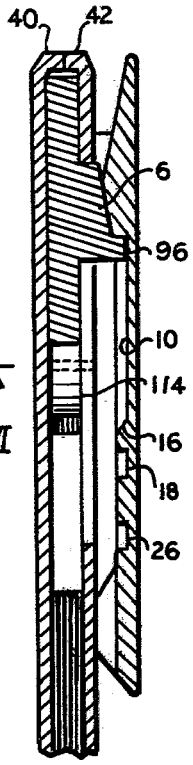
FIG. 2 is a cross-sectional view of the top portion of the instrument shown in FIG. 1 taken on line II—II.
Figure 3:
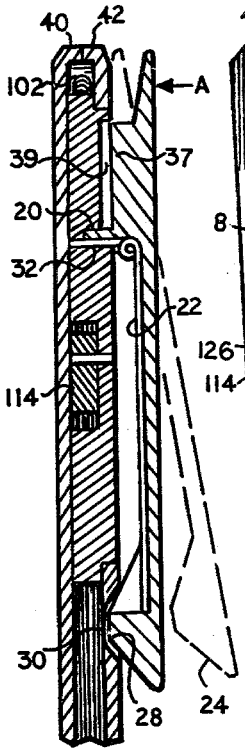
FIG. 3 is a cross-sectional side view of the top portion of the writing instrument shown in FIG. 1 taken on lines III—III.
Figure 4:
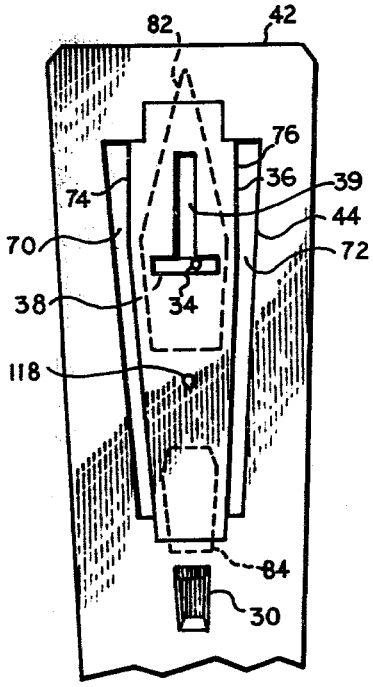
FIG. 4 is a front view of the top portion of the writing instrument with the clip removed.

Referring to FIG. 1, the writing instrument includes a body 2 with a clip 4, a left glide 6 and a right glide 8. Preferably these and most of the other parts of the writing instrument (here illustrated as a ball point pen) are injection molded of a thermoplastic material such as polystyrene. On the underside of clip 4 is provided a left groove or channel 10, a righ groove or channel 12, and a center groove 14. In the path defined by each outer groove, is an incline 16, shown in FIG. 2, and a short groove or notch 18. The clip 4 has a vertical stem 20 which is an integral part of the plastic clip, and a wire coiled torsion spring 22 which is either cemented into the groove 14, ultrasonically welded to it or the like. When the user presses (as the arrow A shows in FIG. 3) on the upper end of the clip, its ball section 28 will move away from the pen body as the dashed lines 24 show. There is another grooved area or notch 26 provided on the inner side of the clip in the path defined by groove 10. Of course, both grooves 10 and 12 are identically shaped. The coil wire torsion spring 22 applies appreciable force to the plastic clip holding its tip against the body as well as reinforcing the clip. The ball section 28 of the clip 4 is partially recessed in a cutout or depression 30 in the body of the instrument, as shown in FIGS. 3 and 4. The recess 30 prevents the clip 4 from sliding sideways or laterally deflecting across the pen body to stress its stem. Also, this requires the clip to be lifted substantially when a piece of material (such as the user's pocket) is passed under the clip, thus providing positive retraction of the writing element when the pen is inserted in a pocket.

The torsion spring 22, as shown in FIG. 3, has its shorter arm 32 press fitted into groove 34 of insert 36 along with stem 20 of clip 4, as shown for example, in FIG. 3. Since such materials tend to fatigue easily, it is preferred to terminate the leg of the clip in a socket of insert 36 within which it may rock, as shown in FIG. 3, and to extend the arm 32 of the spring into a groove in the insert, the spring arm being glued, welded or otherwise secured to the insert to hold the clip to the body of the instrument. However, if other, more expensive plastic materials such as an acetal resin (e.g., Delrin) are employed, materials which do not tend to fatigue easily, then the leg of the clip may be received within and held by an opening in insert 36. Indeed, by using such a material it well may be desirable to omit the spring 22 entirely. A ridge 37 is provided on the upper, inside portion of the clip, which ridge seats in a socket 39 provided in insert 36 (as shown for example in FIGS. 3 and 4). This holds the clip in proper alignment on the body of the instrument and resists lateral deflecting forces applied to the clip.

The pen body 2 consists of two halves, or portions, 40 and 42, which are identical in their outside shape and thicknesses and are joined together by ultrasonic welding, cementing or the like. Body portion 42 differs from portion 40 in that it has a window cutout 44, preferably shaped as illustrated in FIG. 4. The insert 36 fits with its peripheral walls within the window cutout 44 to form slots 70 and 72. Because of the straight, parallel side walls 74 and 76 of the insert 36, the slots 70 and 72 widen at their upper ends. This feature significantly aids in assembly of the instrument.

Figure 8:
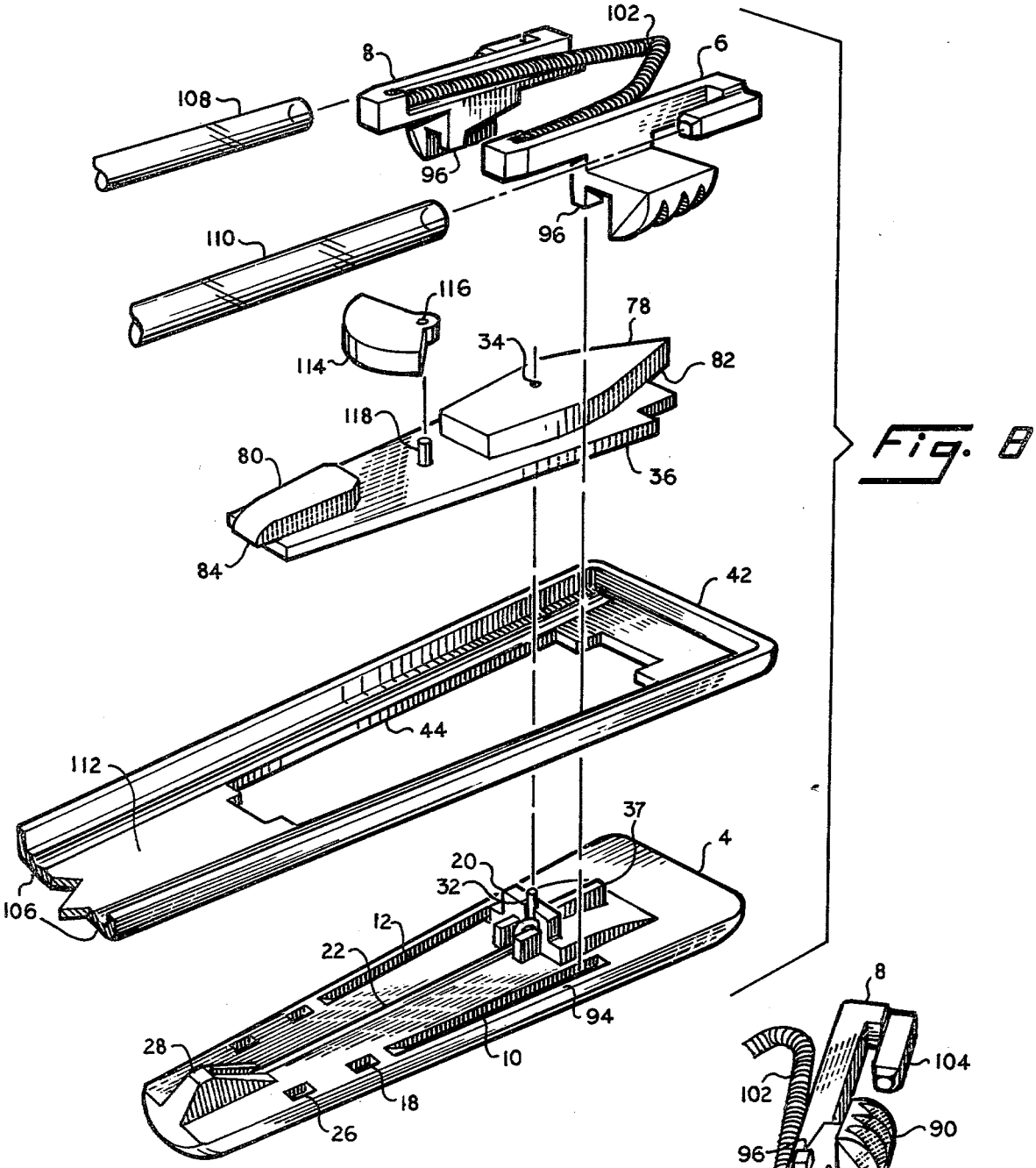
FIG. 8 is an exploded view of the top, front portion of the writing instrument showing its various operative elements.

The insert 36, as shown in perspective in FIG. 8, has a heavy upper section 78 in which the hole or groove 34 is formed, and a heavy lower section 80. The upper section of the insert is shaped as an extension, or cone 82, the tip of which underlies the top of body portion 42 and serves to anchor an expansion spring as described later. At the bottom of the insert 36 is an extension 84 which, when the instrument is assembled, underlies body portion 42. These two extension 82 and 84, together with the portions of insert 36 which interfit within window cutout 44 as shown, secure and lock the insert within the instrument and under body portion 42.

Figure 7:
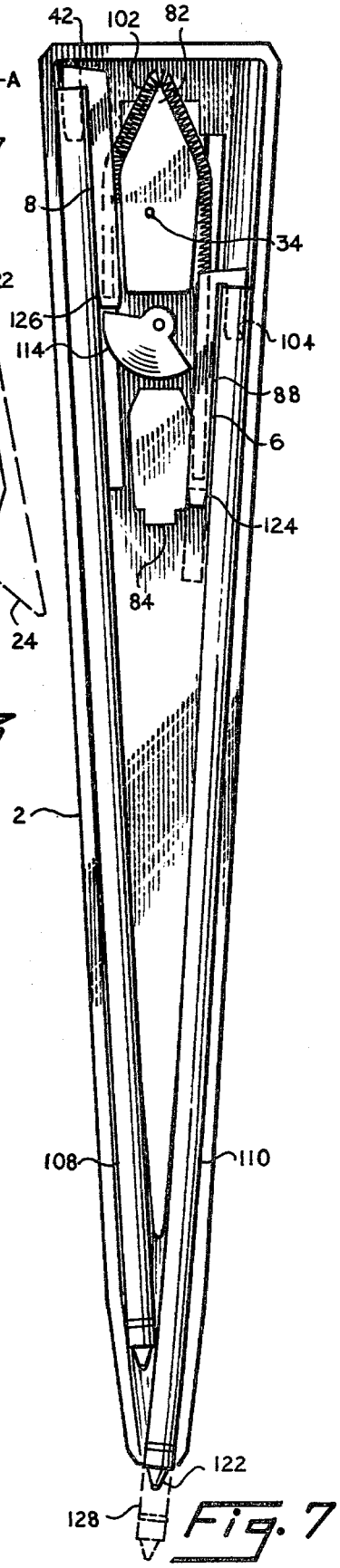
FIG. 7 is a back view of the writing instrument with the back face removed to expose the various elements within the instrument.
Figure 5:
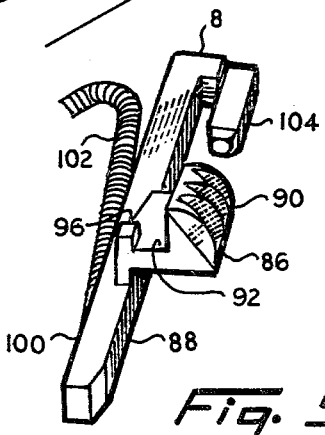
FIG. 5 is an enlarged perspective view of a glide element and its associated spring incorporated within the instrument.
Figure 6:
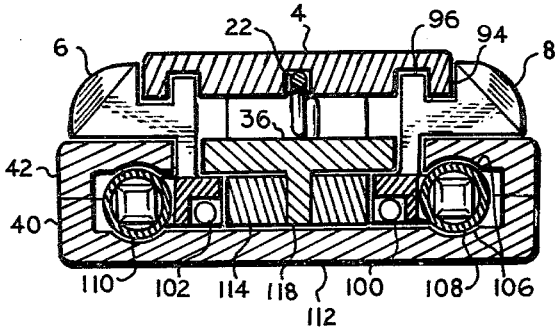
FIG. 6 is an enlarged cross-sectional view taken on lines VI—VI of FIG. 1.

The right glide 8 is shown in perspective in FIG. 5. The left glide is a mirror image of the right glide. The glide consists of an exterior or outer portion 86 which, when the instrument is assembled, is in slideable contact with the top of body portion 42 and the undersurface of clip 4. Its inner or interior section 88 is also shown in FIGS. 5, 7 and 8. The outer portion 86 has an angular section 90 having serrations to receive and grip the user's finger when actuating the pen to extend a writing element. The groove 92 is shaped so that the side wall 94 of the clip 4 easily can be in slideable contact with it, as shown in FIGS. 6 and 8. An intermediate portion of the glide is received in the longitudinal slot 70 or 72 in the body. These slots are located along the underside edges of the clip, as shown for example in FIG. 4; they lie beneath the clip 4 and are therefore concealed by the clip as shown clearly in FIG. 1.

Pin 96 of the glide element slides within the channel in the undersurface of the clip and, by engaging either short groove 18 or 26, serves to lock the writing element in an extended position. The inner portion 88 of the glide consists of a long body which has at its lower portion a groove 100 into which an expansion spiral spring 102 is secured by ultrasonic welding, heating, cement or the like. The other end of the spring 102 is secured in the same manner as the other glide, as shown in FIGS. 7 and 8. The short rectangular section 104 of the glide serves as a plug connector to the interior of the writing element. Because of the angular cross-section of this section, when forced into the top of the writing element it provides a secure frictional attachment as well as defining air vents to the interior of the element. Both body portions 40 and 42 have longitudinal channel 106 for each of the two writing elements 108 and 110 as shown in FIG. 8. This permits the pen to be thinner and yet to have the inner main wall 112 of full thickness. One writing element, for example, may be a red ball point pen cartridge, and the other a blue pen cartridge. The glides may be colored to correspond to the pen colors, or the tips of the elements may be colored to correspond to the pen colors. This latter feature is quite desirable since the user looks at the pen point, not the glides, when using the pen and will readily see the ink color if the point is a corresponding color. A selector cam 114, shown in FIGS. 6, 7 and 8 fits with its opening 116 receiving pin 118 (FIG. 4) of insert 36.

As is apparent from this description, particularly the drawings, the writing instrument includes a body having opposed, substantially flat faces and opposed side walls. Each of the flat faces has a transverse dimension that is substantially greater than the transverse dimension of the side walls, resulting in a flat, elongated body. The side walls extend between the flat faces to provide a substantially transverse, rectangular configuration to the body of the instrument. The interior portions of the body are shaped to form channels that define at least two elongated, generally straight grooves. The longitudinal axes of these grooves or channels are disposed in a substantially common plane between the flat faces, the channels being formed at an acute angle with respect to each other to converge at a common point opening 120 at the bottom end of the body (FIG. 1). The side walls of the body are tapered toward each other from substantially the top end to the bottom end of the writing instrument, and converge at the point opening such that the body of the writing instrument has a continuously decreasing cross-section from the top end to the bottom end thereof. Two elongated writing elements are received in the separate channels formed in the body of the writing instrument, the writing elements each having a longitudinal axis and a writing point at one end thereof. The two glide elements, each being attached to a writing element, are received within the body of the writing instrument, engage the writing elements and provide mostly straight line reciprocation of the writing element on their respective longitudinal axes within the separate elongated channels formed with the body.

As can be seen best in FIG. 7, the channels 108 and 110 receiving the writing elements are shaped to closely fit the elements in their upper portions (about the top 1.2" of their length) and then widen or flare out to loosely receive the elements. Since it is desirable to minimize the movement required to extend a writing element from its retracted to its writing position, the tip of the element should be as close as possible to the opening 120 in the instrument body. However, each element when retracted must provide a clear path for the other. By widening or flaring the channels 108 and 110 to loosely receive the tips of the writing elements, one retracted element may be deflected by the other as it is extended. This in turn permits the tips of the elements to be located much closer to the opening 120, and minimize the movement required to extend an element to a writing position. By closely fitting the upper portion of each channel to the element, the element will be guided into a seating engagement with section 104 of the glide. Also, by properly orienting the axis of this close fitting portion, the writing element when retracted can be held against the outer wall of the channel and away from the path of movement of the other element. Thus, its tip will not fall into the path of travel of the other element and obstruct its insertion or replacement. The inherent flexibility of the writing element permits it to bend slightly during extension. This arrangement also positions the tip of the extended element at a comfortable writing angle.

By this configuration, a flat, elongated, relatively thin writing instrument is provided, one which incorporates sufficient structural strength in the plane defined by the longitudinal axes of the writing elements to withstand the normal forces exerted during use, yet one in which the dimension of the body at right angles to that plane is minimized. Because of this flat shape, the instrument may be used as a bookmark or the like. The flat body of the instrument also affords a sizeable area for advertising or design indicia.

Because of this construction, the clip inherently is relatively wide and flat, providing a substantial area for advertising, as well as a member of adequate strength. This advertising area will be exposed when the pen is being carried in the user's pocket, an important advantage when it is used as a promotional item. Further, because of its substantial size it will distribute forces over a larger area of the pocket and not be as prone to tear the user's clothing as a narrow clip.

Since this construction places the external glide members on the front face of the instrument and adjacent the clip, they will not tend to exert an irritating pressure on the user's hand, nor be as prone to inadvertent actuation during use of the instrument, permitting the writing element to retract. Also, the slots receiving the glide elements are concealed under the clip, providing a streamlined, attractive writing instrument.

In operation, the user pulls down, for example, the right glide 8 to its writing position 8*a* as shown in broken lines in FIG. 1. By doing so he extends or stretches spring 102 from its center, this center portion being captured or locked over the apex of cone 82. During this extension pin 96 slides in groove 12 until it passes under incline 16 and snaps into groove 18 due to the spring tension of the clip coil spring 22. It is held in that position by the clip with the pen point 122 exposed as indicated in FIG. 7, this figure showing glide 6 deployed and glide 8 retracted.

At the same time, selector cam 114 rotates clockwise due to the pressure of the lower end 124 of the glide 8. As a result of this rotation of the selector, its opposite flat surface moves upwardly into the path of the other glide and presses against its lower surface 126. This locks glide 6 in position and prevents jamming of the writing elements against one another. Similarly, when glide 6 is pulled down, the selector cam moves counterclockwise and locks glide 8 in position.

When the user desires to retract the point of the writing element, he has two choices. The pen may be attached to a piece of clothing, for example, by sliding the clip over a piece of fabric. This raises the clip upwardly, as shown in dotted lines in FIG. 3, which in turn releases pin 96 from its locked position in short groove 18 (FIG. 2). Spring 102 then pulls the extended glide upwardly to its original, retracted position, withdrawing the writing element within the instrument. Alternatively, the user may press on the upper end of the clip, as arrow A in FIG. 3 indicates. This raises the opposite, open end of the clip and permits the writing element to be retracted as just explained. It also makes insertion of the clip into a pocket easier, while avoiding wear by rubbing on the fabric of the pocket. Since these retraction methods are obvious and readily understood by even an inexperienced user, there is no need for instructions nor any significant likelihood that the user will damage the instrument by improper actuation.

When the user wants to exchange writing elements or cartridges, he extends the point by sliding the desired glide forward while at the same time with his other hand exercises a slight pressure on the upper end of the clip, again as arrow A in FIG. 2 indicates, and releases the pressure on the clip when the glide comes to a stop. This allows pin 96 to bypass locking groove 18 and to be received in the secondary locking groove 26 because the glide has come to a final stop at the base of groove or channel 70. The user then has sufficient gripping area on the end of the writing element, now in the extended position indicated by dashed lines 128 in FIG. 7, to pull the cartridge from stem 104 and to insert a new one. The channel guides the writing element into engagement with the glide and, by urging the element further, it receives stem 104 to be secured within the instrument. This provides a convenient, easy method for replacing the cartridges required without disassembling the instrument and for checking its ink level. By pressing on the upper end of the clip, or by inserting the pen in his pocket, the clip will be lifted to release the catch means and cause the point to retract to its original position. Of course, projections or other means may be provided to hold the glide in its extended positions instead of grooves 18 and 26 if desired, and groove 26 may be omitted altogether, the user simply holding the glide in its extended position with one hand while removing the writing element with the other hand. While the various features of the writing instrument are quite useful in a multi-element pen, they also are useful in a single element pen, as will be apparent to those skilled in this art.

The scope of the invention now will be defined by the following claims.

I claim:

1. A writing instrument including an extendable writing element housed within a body, the instrument including a clip for holding the instrument in the clothing of the user, the improvement comprising:

means for supporting said clip on said body for pivotal movement of said clip about an axis transverse to the longitudinal axis of said body and fixing said clip against longitudinal movement relative to said body, an elongated slot in the body of the instrument, a glide element having a portion received within the elongated slot and a portion received within the instrument for controlling the extension of the writing element from the body of the writing instrument, the guide element including a manually actuated portion in slideable engagement with the external surface of the body and a locking portion received under the clip when the glide element causes the writing element to be extended from the body of the instrument in a writing position, the clip including catch means on the underside of the clip externally of the body to hold the locking portion of the glide element and to thereby hold the writing element in a writing position, the catch means releasing the glide element portion when the clip is pivoted on said axis, and means urging the writing element into a retracted position within the body of the instrument whereby when the clip is pivoted the writing member is automatically retracted into the body of the instrument.

2. A writing instrument as set forth in claim 1 in which the elongated slot is aligned with the major longitudinal axis of the body, the locking portion of the glide element being received under the clip throughout the travel of the glide element in the elongated slot.

3. A writing instrument as set forth in claim 2 in which the clip includes manually depressable means to rock the clip away from the body of the instrument and release the glide element, when extended, thereby permitting the writing element to be retracted into the body of the instrument.

4. A writing instrument as set forth in claim 2 in which the elongated slot is of sufficient length to permit the writing element to be extended to a first, writing position, and also to be extended substantially beyond the first position to a second position in which the writing element may be grasped, removed and replaced.

5. A writing instrument as set forth in claim 2 in which the instrument includes two elongated writing elements, the body of the instrument having opposed, substantially flat faces and opposed side walls, each of the flat faces having a transverse dimension substantially greater than the transverse dimension of the side walls, the side walls extending between the flat faces to provide a substantially transverse, rectangular configuration for the body, the interior portions of the body being shaped to form channel walls and defining at least two elongated and generally straight channels, the channels being disposed in a substantially common plane intermediate the flat faces, the channels being disposed at an acute angle with respect to each other and converging into a common point opening at the bottom end of the body, the side walls of the body being tapered toward each other from substantially the top end to the bottom end of the body and converging at said point opening such that the body has a continuously decreasing cross-section from substantially the top end to the bottom end thereof, the two elongated writing elements each having a longitudinal axis and each having a writing point at one end thereof the writing elements being respectively disposed in the separate channels, the writing instrument including two glide elements, each glide element being attached to a respective writing element, the writing elements being received within the body to be in contact with the glide elements for mostly straight line reciprocation on their respective longitudinal axes within the separate, elongated channels and, when their associated glide element is extended to a writing position, to extend their respective writing points through said point opening to an extended writing position, the writing elements remaining at substantially constant angles with respect to each other during the entire straight line reciprocation in their respective channels, the writing instrument further including two longitudinal slots, each slot receiving a portion of a respective glide element, the slots being generally parallel to and along opposed sides of the clip, the clip being pivotally attached to the instrument to overlie one flat face, one of the portions of the glide elements also overlying the flat face adjacent the clip whereby either glide element may be manually actuated to cause the associated writing element to move in its respective channel toward the point opening and into an extended, writing position, the spacing between the opposed, substantially flat faces of the body being established to provide the requisite structural strength for the writing instrument in the plane defined by the longitudinal axes of the writing elements yet to minimize the dimension of the body at right angles to the plane, whereby the body is relatively thin.

6. A writing instrument as set forth in claim 5 including means to automatically prevent the extension of one writing element upon at least the partial extension of the other writing element.

7. A writing instrument as set forth in claim 5 including means to automatically prevent the extension of either writing element upon at least the partial extension of the other writing element.

8. A writing instrument as set forth in claim 7 in which the means for preventing extension of either writing element includes a cam pivotally attached within the body of the instrument, the cam including portions in the path of travel of the portion of the glide elements within the body of the instrument and pivotal to move out of the path of travel of one glide element and into a position to block the path of travel of the other glide element.

9. A writing instrument as set forth in claim 8 in which the clip includes manually depressable means to rock the clip away from the body of the instrument and release the glide elements, when extended, to permit the associated writing elements to be retracted into the body of the instrument.

10. A writing instrument as set forth in claim 9 in which each writing element is frictionally attached to its associated glide element, and in which the elongated slots are each of sufficient length to permit their associated writing elements to be extended to a first writing position, and also to be extended substantially beyond the first writing position to a second position to permit the writing element to be grasped, removed and replaced, the channels within the body of the instrument guiding a replaced element into interlocking frictional engagement with its associated glide element.

11. A writing instrument as set forth in claim 10 in which the retraction means includes a spring, one end of which is attached to one writing element, the other end of which is attached to the other writing element, an intermediate portion of the spring being attached to the body of the instrument.

12. A writing instrument as set forth in claim 10 in which the clip is molded of a thermoplastic material, the clip including a spring urging its tip into engagement with the body of the writing instrument.

13. A writing instrument as set forth in claim 12 in which the clip includes a projecting tip, and in which the body of the instrument includes a socket for at least partially receiving the tip of the clip and, when the tip is so received, for reinforcing the clip to assist it in resisting lateral motion relative to the body of the instrument.

14. A writing instrument as set forth in claim 13 including a metal spring attached to the clip, reinforcing the clip, and urging the tip of the clip into engagement with the body of the instrument.

15. A writing instrument as set forth in claim 1 including at least two extendable writing elements housed within a single body, the body including a tip at one end and an internal channel for each writing element, and means including said slide element for causing the writing elements to reciprocate along their longitudinal axes within their channels from a retracted position to an extended, writing position in which the point of the writing element is exposed for use beyond the tip of the body, the longitudinal axes of at least some of the channels being curved adjacent the tip of the body to position the points of the retracted writing elements close to the tip but not in the path of an extended writing element, whereby the writing elements travel a short distance from their retracted to their extended position.

16. A writing instrument as set forth in claim 15 in which the channels are substantially larger than the writing elements adjacent the tip of the body, the enlarged channels permitting the writing elements to flex and deflect from a retracted position adjacent the outer side of the channel to an extended position in line with the tip of the body.

17. A writing instrument as set forth in claim 16 in which the portion of the writing channels furthermost from the tip of the body snugly receive the writing elements, these portions being longitudinally aligned to hold the writing elements, when retracted, in a position adjacent the outer side of the channel near the tip portion of the body.

18. A writing instrument as set forth in claim 1 in which the elongated body has a tip portion at one end, the body also having an elongated interior channel terminating in an opening at the tip portion, the extendable writing element being movably received in the channel within the body, and means including the glide element for causing an end portion of the writing element to be extended beyond the tip portion of the writing element to be extended beyond the tip portion of the body to a first, writing position or to be extended substantially beyond the first position to a second position in which the writing element may be grasped, removed and replaced.

19. A writing instrument as set forth in claim 18 in which the body includes two longitudinal channels terminating in a common opening at the tip portion of the body, and an extendable writing element received within each longitudinal channel, the means for extending the writing element selectively causing either writing element to be extended beyond the tip portion of the body to the first or second position.

20. The writing instrument of claim 1, the elongated slot lying under and being concealed by said clip.

* * * * *